US009018432B2

(12) United States Patent
Farmer et al.

(10) Patent No.: US 9,018,432 B2
(45) Date of Patent: Apr. 28, 2015

(54) PROCESSING RADIOACTIVE WASTE FOR SHIPMENT AND STORAGE

(71) Applicant: Barnhardt Manufacturing Company, Charlotte, NC (US)

(72) Inventors: Steven T. Farmer, Pfafftown, NC (US); Richard T. Stoehr, King, NC (US); Richard L. Rose, Nampa, ID (US)

(73) Assignee: Barnhardt Manufacturing Company, Charlotte, NC (US)

( * ) Notice: Subject to any disclaimer, the term of this patent is extended or adjusted under 35 U.S.C. 154(b) by 272 days.

(21) Appl. No.: 14/027,423

(22) Filed: Sep. 16, 2013

(65) Prior Publication Data

US 2014/0121439 A1 May 1, 2014

Related U.S. Application Data

(60) Provisional application No. 61/718,215, filed on Oct. 25, 2012.

(51) Int. Cl.

| | |
|---|---|
| ***G21F 9/00*** | (2006.01) |
| ***G21F 1/10*** | (2006.01) |
| ***G21F 9/30*** | (2006.01) |
| ***G21F 9/36*** | (2006.01) |
| *G21F 5/005* | (2006.01) |

(52) U.S. Cl.

CPC . *G21F 1/10* (2013.01); *G21F 5/005* (2013.01); *G21F 9/30* (2013.01); *G21F 9/36* (2013.01)

(58) Field of Classification Search

USPC ..... 588/8, 6, 412, 249, 252, 901

See application file for complete search history.

(56) References Cited

U.S. PATENT DOCUMENTS

| | | | | |
|---|---|---|---|---|
| 4,100,860 | A | 7/1978 | Gablin et al. | |
| 4,486,512 | A | 12/1984 | Tozawa et al. | |
| 4,836,975 | A | 6/1989 | Guldner et al. | |
| 7,250,119 | B2 | 7/2007 | Sayala | |
| 7,553,431 | B2 * | 6/2009 | Hayner et al. | 252/478 |
| 2010/0256323 | A1 | 10/2010 | Athey et al. | |
| 2012/0009414 | A1 | 1/2012 | Golini | |

FOREIGN PATENT DOCUMENTS

| | | | |
|---|---|---|---|
| GB | 2047946 | A | 12/1980 |

OTHER PUBLICATIONS

International Search Report and Written Opinion of corresponding International Application No. PCT/US13/63769 (Publication No. WO 2014/105250); mail date: Jun. 13, 2014; 6 pages.

* cited by examiner

*Primary Examiner* — Edward Johnson

(74) *Attorney, Agent, or Firm* — Shumaker, Loop & Kendrick, LLP

(57) ABSTRACT

A process for encapsulating a radioactive object to render the object suitable for shipment and/or storage, and including the steps of preparing a plastic material, causing the plastic material to react with a foaming agent, generating a foaming plastic, encapsulating the radioactive object in the foaming plastic, and allowing the foaming plastic to solidify around the radioactive object to form an impervious coating.

10 Claims, 6 Drawing Sheets

PROCESSING RADIOACTIVE WASTE FOR SHIPMENT AND STORAGE

CROSS-REFERENCE TO RELATED APPLICATIONS

This application claims priority to U.S. Application No. 61/718,215 filed Oct. 25, 2012, the contents of which are incorporated by reference herein.

TECHNICAL FIELD AND BACKGROUND OF THE INVENTION

This invention relates to a composition and process for processing radioactive waste materials to render them suitable for shipment and/or storage. Radioactive waste materials, especially those resulting from the processing of uranium and plutonium, are particularly dangerous to transport to sites for final disposition, such as long-term storage or further processing. Such waste encompasses a wide range of material, and may include piping, building materials, machinery and equipment, furniture, weapons casings and the like.

Radioactive waste, especially from the processing of uranium and plutonium, is usually buried for its final disposition. The current state of technology includes the steps of filling all of the interstitial spaces in the radioactive material with cement, and then micro-encapsulating the material with more cement. There are several shortcomings to this method. First, the resultant encapsulating material is very heavy. Cement has a typical density about 120 lbs/ft$^3$, so it would not be unusual to have a large piece of contaminated equipment weigh in excess of 100,000 lbs. This necessitates the use of expensive, heavy equipment to move these structures. Second, the pouring of cement in situ over the encapsulated material (i.e. in the landfill) is an extraordinarily inefficient use of space. A large amount of cement is spilled over the sides of the material due to the inexact nature of pouring cement. This causes much more landfill space to be used than would be the case with a more focused process. Third, cement is well known to crack when exposed to tensile stress, temperature extremes, or when non-optimal water/cement ratios are used. When cracking in these monolithic structures occurs, there is a greater risk that radioactive waste will migrate from the structure into an uncontrolled environment.

The use of polyurethanes for the purpose of encapsulation of radioactive materials is known in the prior art. The known prior art describes the use of one of several types of cement/mortar, sand, filler, or other additives to the polyurethane to either create a high density monolithic block, or as an aid for radiation attenuation. The novelty of the present invention resides in the lack of solid fillers or cement/mortar, as well as the optional inclusion of an elastomeric coating to encapsulate and protect the radioactive material from possible damage in transport.

UK Patent No. GB2047946 to Pordes et al. discloses the encapsulation of radioactive waste material, particularly wet ion exchange resin, by dispersing the waste in an aqueous emulsion of an organic polyol, a polyisocyanate and an hydraulic cement, and allowing the emulsion to react and form a monolithic block.

U.S. Pat. No. 7,250,119 to Sayala discloses the use of naturally occurring minerals in synergistic combination with formulated modified cement grout matrix, polymer modified asphaltene and maltene grout matrix, and polymer modified polyurethane foam grout matrix to provide a neutron and gamma radiation shielding product.

U.S. Pat. No. 4,100,860 to Gablin et al. discloses a shipping container overpack for transportation of radioactive materials, and includes a leakproof receptacle for containing and protecting the material against accidental release. The receptacle has spaced inner and outer shells into which polyurethane foam is poured to create a stress skin structure.

U.S. Pat. No. 4,486,512 to Tozawa et al. discloses a waste sealing container constructed by depositing a foundation of zinc over a steel base, then coating an organic synthetic resin paint containing a metal phosphate over the foundation coating, and thereafter coating an acryl resin, epoxy resin, and/or polyurethane paint.

The above-described processes and resulting structures retain many of the disadvantages of the prior art, and thus a more cost-effective, efficient and safe means of processing radioactive waste for shipping and storage is needed.

SUMMARY OF THE INVENTION

Therefore, it is an object of the invention to provide encapsulation materials and methods for application in the field of radioactive materials that do not require a cementitious material or grout as a constituent part of the material.

It is another object of the invention to provide a mechanism for safe transport of radioactive materials with far less weight (approximately $1/20^{th}$ the weight of cement) and occupying far less space in its burial site.

It is another object of the invention to provide encapsulation materials and methods for application in the field of radioactive material that provides superior tensile strength and elongation that will resist cracking for long periods of time, unlike cementitious materials, which are subject to deterioration over time.

The present invention includes the use of a foaming plastic, optionally covered with an elastomeric coating, for the purpose of encapsulating radioactive material that may or may not have been coated with a primer to render it attenuated and properly encased for safe transport while mitigating the risk of radioactive materials escaping.

These and other objects of the invention are achieved by providing process for encapsulating a radioactive object to render the object suitable for shipment and/or storage, and including the steps of preparing a plastic material, causing the plastic material to react with a foaming agent, generating a foaming plastic, encapsulating the radioactive object in the foaming plastic, and allowing the foaming plastic to solidify around the radioactive object to form an impervious coating.

According to one aspect of the invention, the step of encapsulating the radioactive object includes the steps of filling a void in the object with the foaming plastic and encasing the object in an outer layer of foaming plastic.

According to another aspect of the invention, the step of encapsulating the radioactive object includes the step of placing the object in a bag before encasing the object in an outer layer of foaming plastic.

According to another aspect of the invention, the step of encapsulating the radioactive object includes the step of applying an outer layer of an elastomeric coating to the object.

According to another aspect of the invention, a process for encapsulating a radioactive object to render the object suitable for shipment and/or storage is provided, and includes the steps of preparing a plastic material, causing the plastic material to react with a foaming agent, generating a foaming plastic, placing a radioactive object in a container, encapsulating the container in the foaming plastic, and allowing the foaming plastic to solidify around the container to form an impervious coating.

According to another aspect of the invention, the method includes the steps of evacuating displaced air from the container as the container is encapsulated and transferring the air to another treatment location.

According to another aspect of the invention, a method of encapsulating a radioactive object to render the object suitable for shipment and/or storage includes the steps of preparing a plastic material, causing the plastic material to react with a foaming agent, generating a foaming plastic, and encapsulating the object in the foaming plastic. The step of encapsulating the object in the foaming plastic includes the steps selected from the group consisting of placing a radioactive object in a container, encapsulating the container in the foaming plastic, and allowing the foaming plastic to solidify around the container to form an impervious coating; and encapsulating the radioactive object in the foaming plastic, allowing the foaming plastic to solidify around the radioactive object to form an impervious coating.

According to another aspect of the invention, the step of encapsulating the radioactive object includes the steps of filling a void in the object with the foaming plastic and encasing the object in an outer layer of foaming plastic.

According to another aspect of the invention, various formulations are disclosed having various physical characteristics suitable for encapsulating objects in a foaming plastic in preparation for shipment and storage.

DETAILED DESCRIPTION OF THE INVENTION AND BEST MODE

Figure 1:
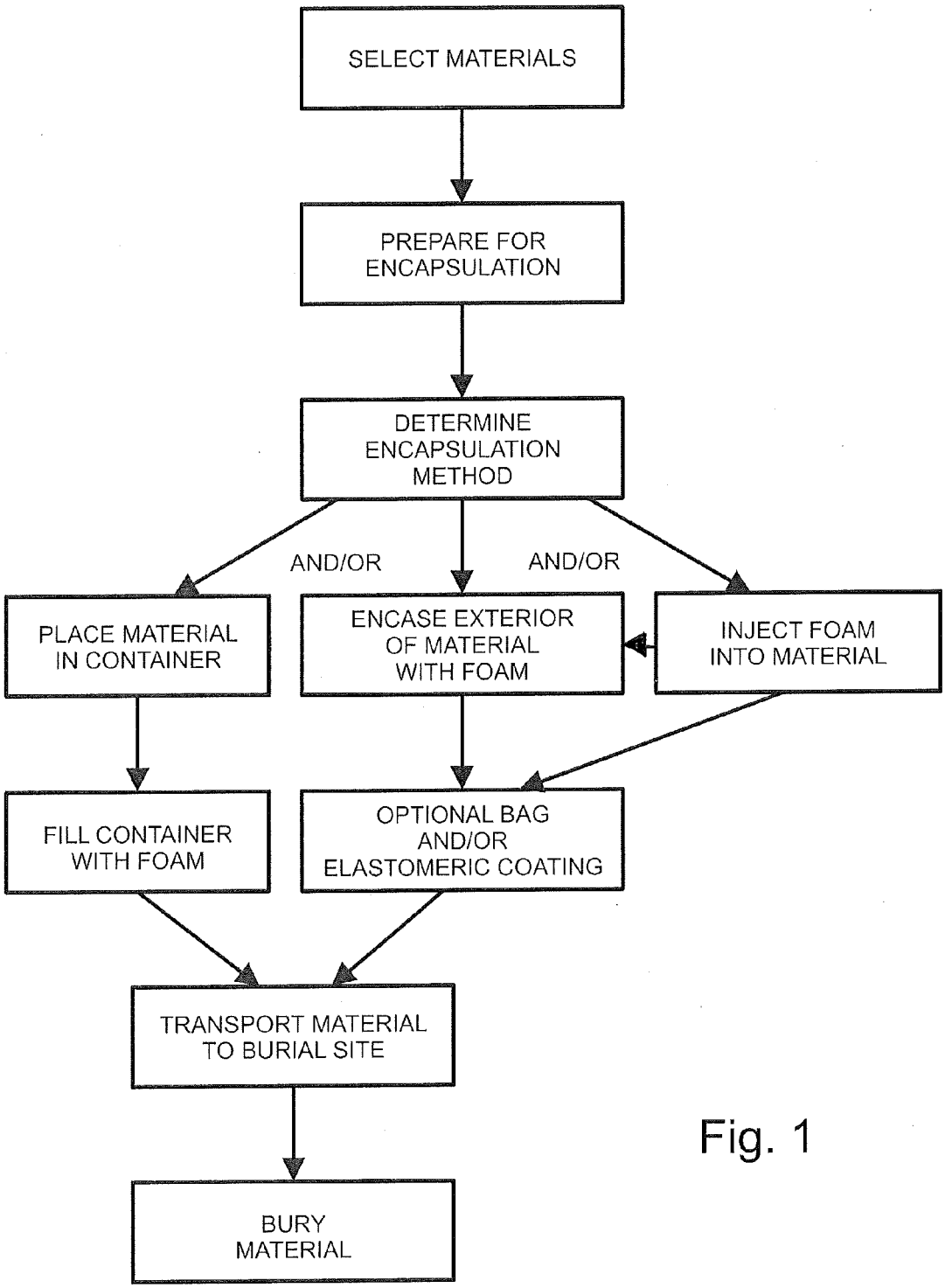
FIG. 1 is a flow diagram of one preferred embodiment of a method of encapsulating radioactive materials contained in an enclosure.

Referring now specifically to the drawings, FIG. 1 is a flow diagram showing by way of example an iteration of the method steps that may be used to carry out the method according to one preferred embodiment of the invention.

First, candidate objects are examined to determine the appropriateness for treating with foaming plastic in downstream steps. Some objects may be incinerated or processed by different methods. Those objects, such as described above, selected for processing are prepared based on the type and physical characteristics of the object. For example, objects such as piping may first be cleaned and loose material, particularly in the interior of the pipe, either removed or primed onto the surface. The selection and preparation steps will determine the particular process to be used in the next steps. As shown in FIG. 1, large objects, such as machinery, barrels, and the like may be placed in a container, and then encapsulated by filling the container with foaming plastic. Other materials, such a piping, may be first injected with foam, then the exterior encapsulated with foaming plastic. The foaming plastic expands into interstitial cracks, fractures and surface irregularities. This effectively fixes the radioactive material in place in or on the object and protects it from later contact or removal.

Whether or not the object is encased with an outer layer of foam plastic, the object may then optionally be placed in a bag to further protect against eventual leakage. Once completely encapsulated according to the selected method steps, the object is ready to be shipped to a burial site for burial.

Figure 2:
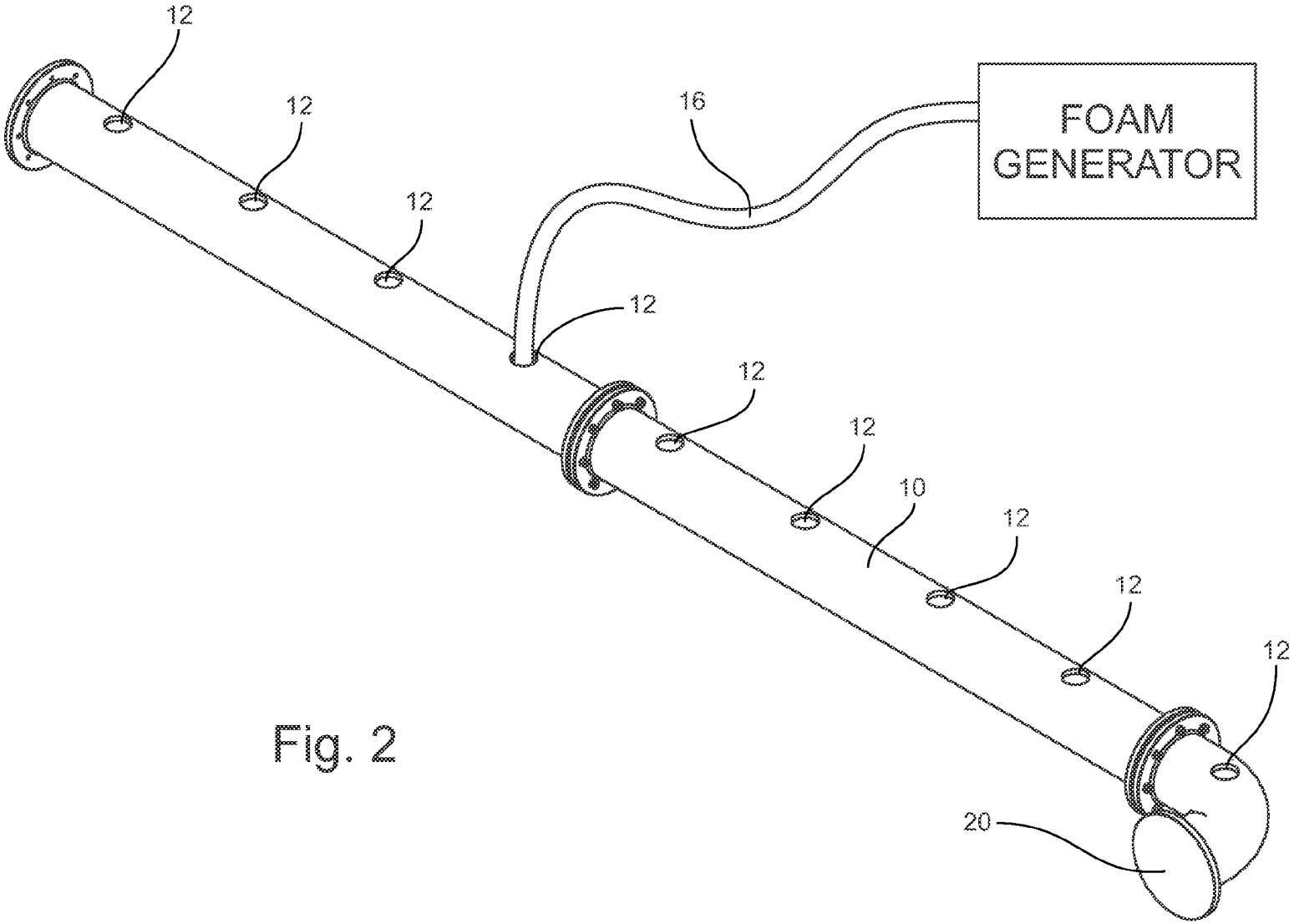
FIG. 2 illustrates a method step of filling a pipe containing radioactive materials by injecting foaming plastic into the pipe at predetermined positions along the length of the pipe.

Referring now to FIG. 2, a typical object that may be radioactively contaminated, a length of pipe 10, is processed by priming or otherwise stabilizing the interior surface, then forming holes 12 in the pipe 10. The method is advantageous when dealing with long lengths of pipe, hose or other elongate object where, due to the length of the object, it may be impractical to inject foaming plastic into the object through or adjacent one end. Plastic is foamed in a foam generator 14 and conveyed through a hose 16 to the holes 12, and foam "F" is injected into the holes 12 successively from one end of the pipe 10 to the other. A temporary or permanent cap 20 may be placed over the ends of the pipe 10 as shown to prevent foam from exiting the pipe 10 through its ends. After injection of the foam in complete, the holes 12 are plugged or capped.

Figure 3:
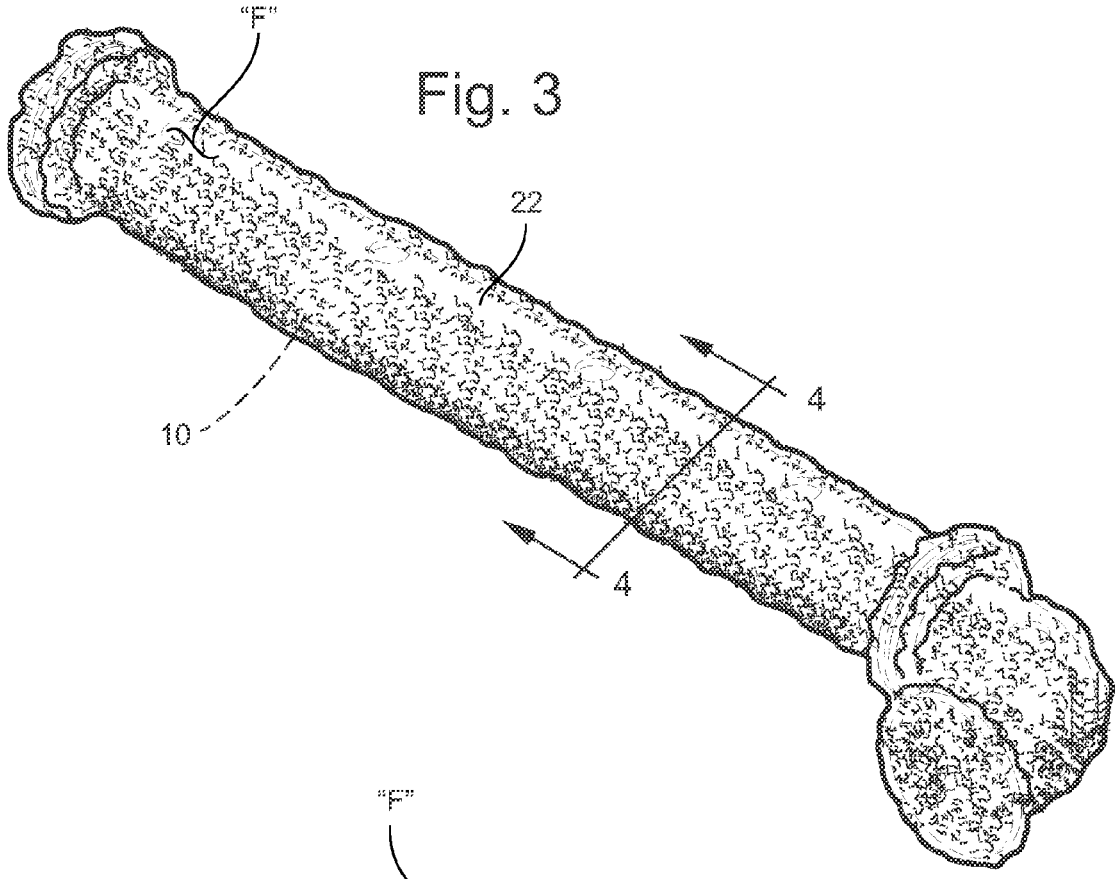
FIG. 3 illustrates a method step of encapsulating a radioactively contaminated object with foam after voids in the object have been filled.
Figure 4:
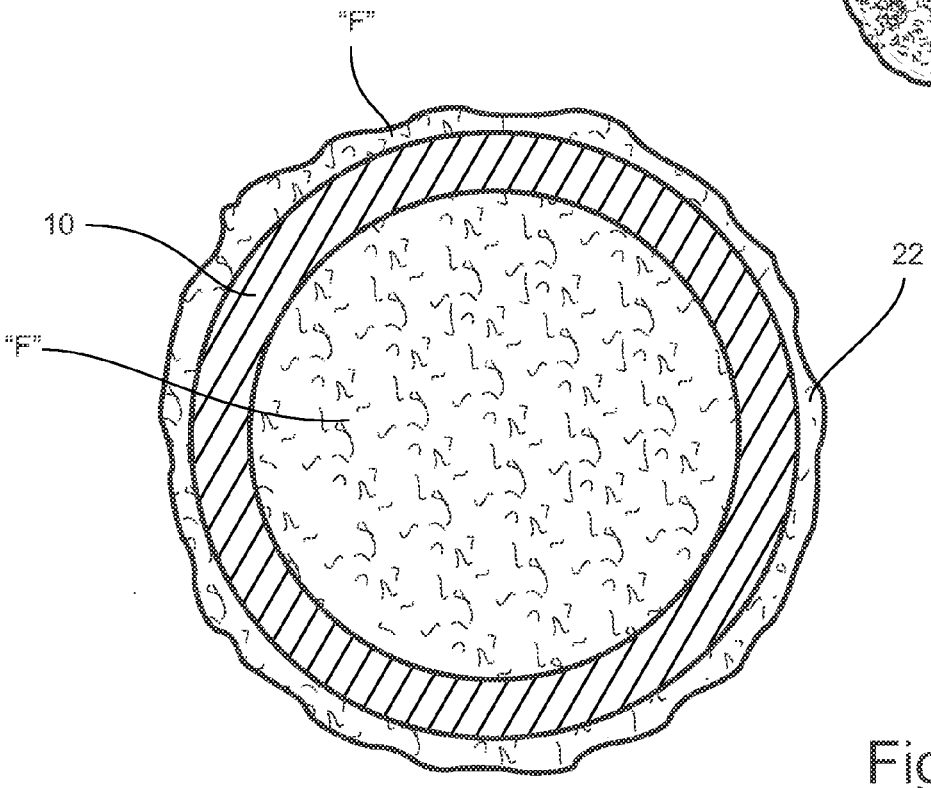
FIG. 4 is a cross-section taken along line 4-4 of FIG. 3.

FIGS. 3 and 4 illustrate that once the pipe 10 has been filled with foam "F" as shown in FIG. 2, the exterior of the pipe 10 may optionally be coated with a layer 22 of foam "F".

Figure 5:
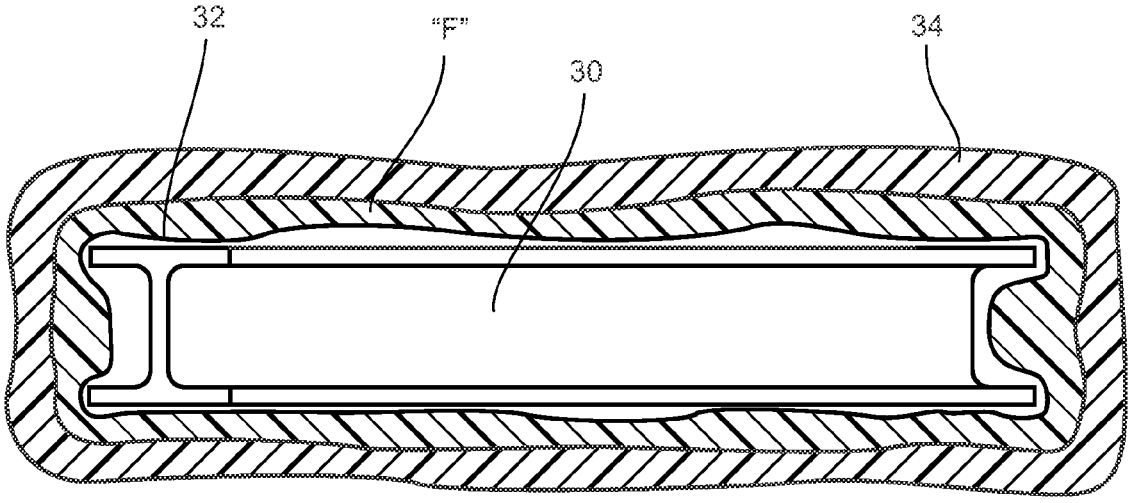
FIG. 5 illustrates a method step wherein radioactive material is enclosed within a bag as a part of the encapsulation process.

Referring to FIG. 5, an object, for example, a length of I-beam 30 is first sealed in a heavy plastic bag 32. Then, foam "F" is used to completely encapsulate the bagged I-beam 30. Optionally, an elastomeric coating 34 may be placed over the foam "F". The elastomeric coating 34 will provide greater resistance to tensile and tear stress, damage during transport, and cracking.

Figure 6:
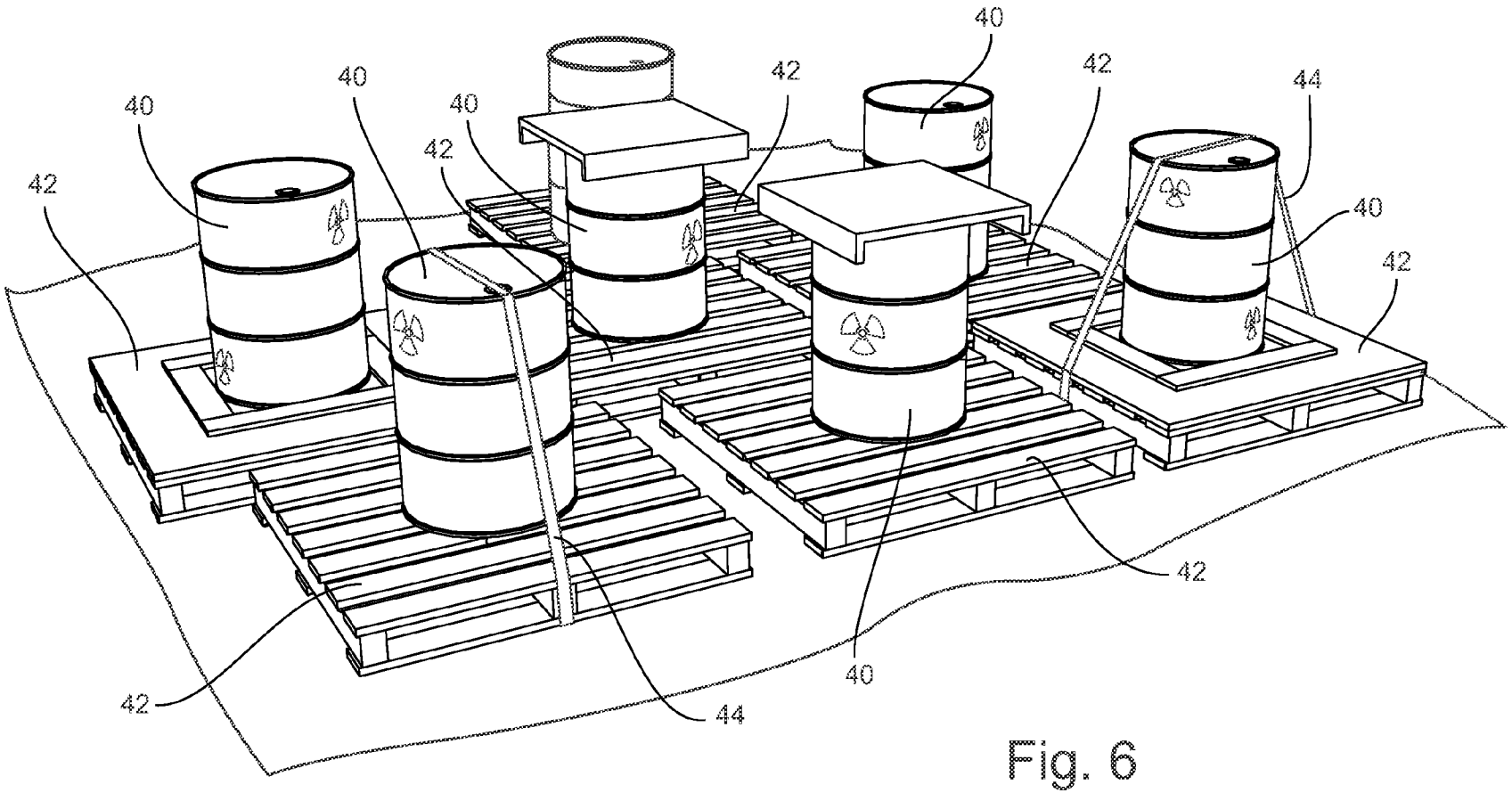
FIG. 6 illustrates an intermediate step in a method of encapsulating materials wherein the materials are secured to a pallet.
Figure 7:
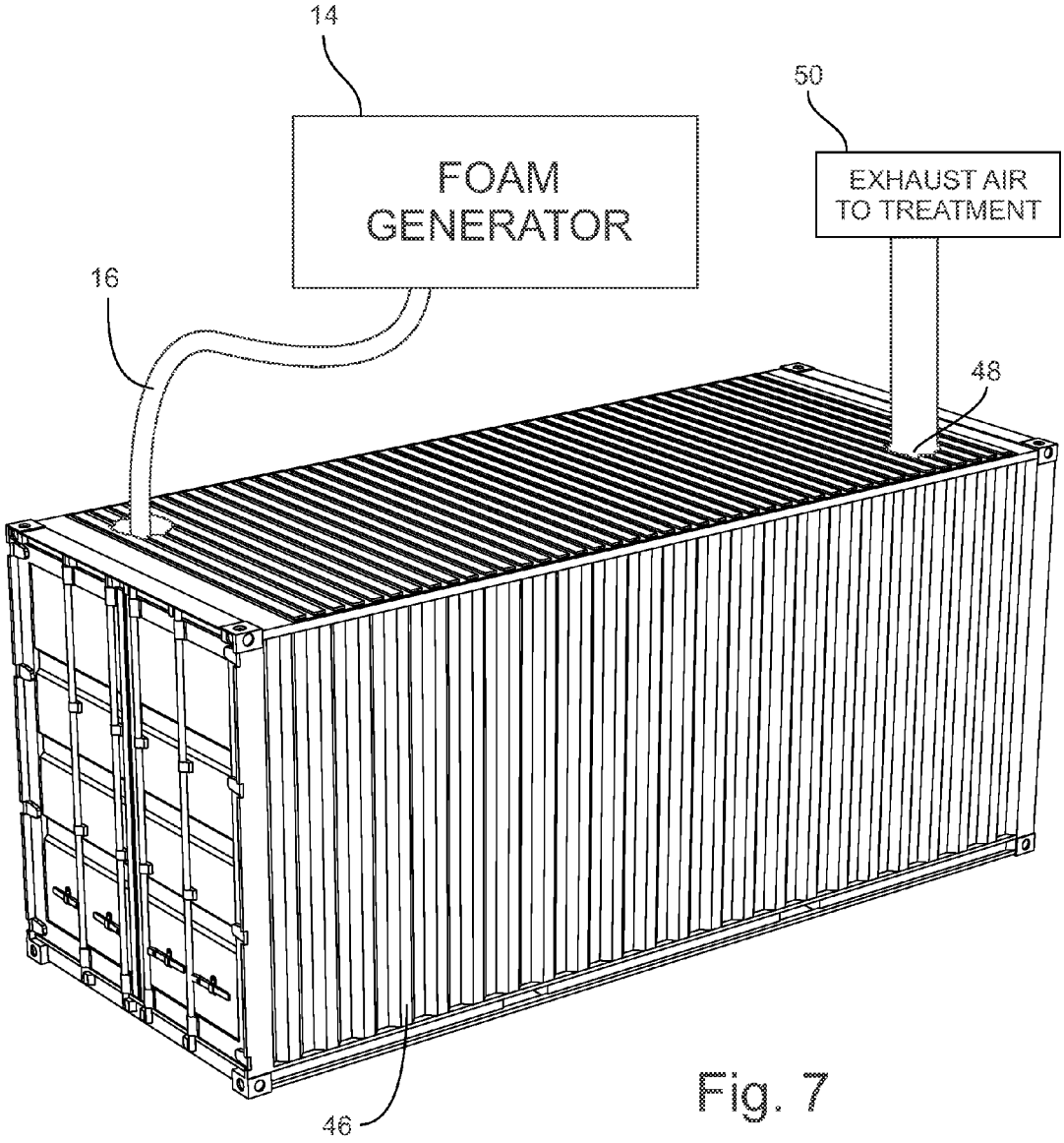
FIG. 7 illustrates filling a box containing materials prepared such as in FIG. 5 with foaming plastic according to the method of the invention.

Referring now to FIGS. 6 and 7, a method for encapsulating large, bulky objects is explained. By way of example, barrels 40, which may themselves be contaminated and/or containing radioactively-contaminated waste, liquid or solid, are placed on pallets 42 and fastened in a suitable manner, as by straps 44. One or more pallets 42 and barrels 40 are then placed in a container 46, for example, as shown in FIG. 7, and then the entire container 46 is filled with foam "F" by injecting it from the foam generator 14 through hose 16. In some instances it will be necessary to provide an outlet 48 to permit contaminated air displaced by the introduction of the foam "F" to be removed to another location 50 for treatment. After the container 46 is filled, it is shipped to a suitable location for burial.

More generally, a foaming plastic such as the foam "F" can be used to encapsulate primed or unprimed radioactive waste, thus containing and immobilizing the waste, making it safe to transport to a landfill. The foaming plastic can be poured, sprayed, or otherwise dispensed in and around the contaminant, allowing the foam to rise and fill the interstitial spaces. The foam can also be dispensed over already encapsulated objects that may or may not be primed to render it completely macro-encapsulated and attenuated for further transport. The foam can be injected into pipes, ductwork, or other contaminated spaces where it will fill the voids and immobilize any radioactive materials.

The methods of forming a foam generally include providing a blowing agent composition of the present disclosure, adding (directly or indirectly) the blowing agent composition to a foamable composition, and reacting the foamable composition under the conditions effective to form a foam or cellular structure. Any of the methods well known in the art, such as those described in "Polyurethanes Chemistry and Technology," Volumes I and II, Saunders and Frisch, 1962, John Wiley and Sons, New York, N.Y., which is incorporated herein by reference, may be used or adapted for use in accordance with the foam embodiments.

Polyisocyanate-based foams are prepared, e.g., by reacting at least one organic polyisocyanate with at least one active hydrogen-containing compound in the presence of the blowing agent composition described in this application.

An isocyanate reactive composition can be prepared by blending at least one active hydrogen-containing compound with the blowing agent composition. According to preferred embodiments of the invention, the blend contains at least 1 and up to 50, preferably up to 25 weight percent of the blowing agent composition, based on the total weight of active hydrogen-containing compound and blowing agent composition.

Active hydrogen-containing compounds include those materials having two or more groups which contain an active hydrogen atom which reacts with an isocyanate. Preferred among such compounds are materials having at least two hydroxyl, primary or secondary amine, carboxylic acid, or thiol groups per molecule. Polyols, i.e., compounds having at least two hydroxyl groups per molecule, are especially preferred due to their desirable reactivity with polyisocyanates.

Additional examples of suitable active hydrogen containing compounds can be found in U.S. Pat. No. 6,590,005. For example, suitable polyester polyols include those prepared by reacting a carboxylic acid and/or a derivative thereof or a polycarboxylic anhydride with a polyhydric alcohol. The polycarboxylic acids may be any of the known aliphatic, cycloaliphatic, aromatic, and/or heterocyclic polycarboxylic acids and may be substituted, (e.g., with halogen atoms) and/or unsaturated. Examples of suitable polycarboxylic acids and anhydrides include oxalic acid, malonic acid, glutaric acid, pimelic acid, succinic acid, adipic acid, suberic acid, azelaic acid, sebacic acid, phthalic acid, isophthalic acid, terephthalic acid, trimellitic acid, trimellitic acid anhydride, pyromellitic dianhydride, phthalic acid anhydride, tetrahydrophthalic acid anhydride, hexahydrophthalic acid anhydride, endomethylene tetrahydrophthalic acid anhydride, glutaric acid anhydride acid, maleic acid, maleic acid anhydride, fumaric acid, and dimeric and trimeric fatty acids, such as those of oleic acid which may be in admixture with monomeric fatty acids. Simple esters of polycarboxylic acids may also be used such as terephthalic acid dimethylester, terephthalic acid bisglycol and extracts thereof. The polyhydric alcohols suitable for the preparation of polyester polyols may be aliphatic, cycloaliphatic, aromatic, and/or heterocyclic. The polyhydric alcohols optionally may include substituents which are inert in the reaction, for example, chlorine and bromine substituents, and/or may be unsaturated. Suitable amino alcohols, such as monoethanolamine, diethanolamine or the like may also be used. Examples of suitable polyhydric alcohols include ethylene glycol, propylene glycol, polyoxyalkylene glycols (such as diethylene glycol, polyethylene glycol, dipropylene glycol and polypropylene glycol), glycerol and trimethylolpropane.

Suitable additional isocyanate-reactive materials include polyether polyols, polyester polyols, polyhydroxy-terminated acetal resins, hydroxyl-terminated amines and polyamines, and the like. These additional isocyanate-reactive materials include hydrogen terminated polythioethers, polyamides, polyester amides, polycarbonates, polyacetals, polyolefins, polysiloxanes, and polymer polyols.

Other polyols include alkylene oxide derivatives of Mannich condensates, and aminoalkylpiperazine-initiated polyethers as described in U.S. Pat. Nos. 4,704,410 and 4,704,411. The low hydroxyl number, high equivalent weight alkylene oxide adducts of carbohydrate initiators such as sucrose and sorbitol may also be used.

In the process of making a polyisocyanate-based foam, the polyol(s), polyisocyanate and other components are contacted, thoroughly mixed and permitted to expand and cure into a cellular polymer. The particular mixing apparatus is not critical, and various types of mixing head and spray apparatus may be used. It is often suitable, but not necessary, to preblend certain of the raw materials prior to reacting the polyisocyanate and active hydrogen-containing components. For example, it is often useful to blend the polyol(s), blowing agent, surfactant(s), catalyst(s) and other components except for polyisocyanates, and then contact this mixture with the polyisocyanate. Alternatively, all the components may be introduced individually to the mixing zone where the polyisocyanate and polyol(s) are contacted. It is also possible to pre-react all or a portion of the polyol(s) with the polyisocyanate to form a prepolymer.

The invention is further described according to the several examples set out below:

EXAMPLE 1

A rigid polyurethane foam with the following composition and physical properties was produced by dispensing through high pressure impingement mix equipment.

| INGREDIENT | % |
|---|---|
| Polyol blend | 34.78 |
| Crosslinkers | 1.45 |
| Water | 0.48 |
| Fire retardant | 3.60 |
| Viscosity suppressant | 1.09 |
| Surfactants | 0.72 |
| Catalysts | 0.14 |
| Blowing agent | 6.04 |
| Polymeric Isocyanate | 51.70 |
| TOTAL | 100.00 |

Free Rise Core Density: 2.4 lbs/ft$^3$
Molded Core Density: 2.8 lbs/ft$^3$
Compressive Strength: 37 lbs/in$^2$
UL Bulletin 94: Passes HBF

| | |
|---|---|
| Mil-PRF-26514G | Meets Type 1, Class 1 |
| Mil-PRF-83671B | Meets Class 1, Category 1 |

The foam was dispensed into pipes ranging in diameter from 2 inches to 8 inches. The foam completely filled the pipe, rendering the radioactive material encapsulated. The piping could then be safely cut into sections without the risk of releasing radioactive materials, and safely transported to a designated site for burial.

EXAMPLE 2

A rigid polyurethane foam with the following composition and physical properties was produced by dispensing through high pressure impingement mix equipment:

| INGREDIENT | % |
|---|---|
| Polyol blend | 34.45 |
| Crosslinkers | 3.83 |
| Water | 0.05 |
| Fire retardant | 3.83 |
| Viscosity suppressant | 1.41 |
| Surfactants | 0.72 |
| Catalysts | 0.12 |
| Blowing agent | 3.44 |
| Polymeric Isocyanate | 52.15 |
| TOTAL | 100.00 |

Free Rise Core Density: 6.3 lbs/ft$^3$
Compressive Strength: 135 lbs/in$^2$
UL Bulletin 94: Passes HBF The foam was pumped into large cylindrical spaces up to 40 inches diameter and 40 inches high for encapsulation of uranium converters. It allowed the converters, which comprise hundreds of tubes for uranium enrichment, to then be safely moved in their entirety to a designated site for burial. There was no need to cut the converters and potentially risk leaking radioactive material.

EXAMPLE 3

A rigid polyurethane foam with the following composition and physical properties was produced by dispensing through high pressure impingement mix equipment:

| INGREDIENT | % |
|---|---|
| Polyol blend | 39.38 |
| Crosslinkers | 1.65 |
| Water | 0.12 |
| Viscosity suppressant | 3.07 |
| Surfactants | 0.47 |
| Catalysts | 0.12 |
| Blowing agent | 2.36 |
| Polymeric Isocyanate | 52.83 |
| TOTAL | 100.00 |

Free Rise Core Density: 6.0 lbs/ft$^3$
Compressive Strength: 160 lbs/in$^2$

The foam is used to encapsulate and immobilize large volume spaces. This can be a dumpster-like container, piping, ductwork, or any large volume space with or without interstitial spaces to fill.

EXAMPLE 4

A rigid polyurethane foam with the following composition and physical properties was produced by dispensing through high pressure impingement mix equipment:

| INGREDIENT | % |
|---|---|
| Polyol blend | 33.50 |
| Crosslinkers | 4.78 |
| Water | 0.10 |
| Fire retardant | 4.31 |
| Viscosity suppressant | 0.57 |
| Surfactants | 0.38 |
| Catalysts | 1.82 |
| Blowing agent | 2.39 |
| Polymeric Isocyanate | 52.15 |
| TOTAL | 100.00 |

Free Rise Core Density: 6.5 lbs/ft$^3$
Compressive Strength: 150 lbs/in$^2$

The foam is sprayed onto equipment or encapsulating bags to smooth out the surface, and attenuate the radioactive material.

EXAMPLE 5

A polyurea elastomeric coating with the following composition and physical properties was produced by dispensing through high pressure impingement mix equipment to form an outer coating:

| INGREDIENT | % |
|---|---|
| Polyetheramine blend | 42.31 |
| Amine Crosslinker | 4.81 |
| Moisture Scavenger | 0.96 |
| Isocyanate Prepolymer | 51.92 |
| TOTAL | 100.00 |

Tensile Strength: 3000 lbs/in$^2$
Tear Strength: 436 lbs/in
Elongation: 364%
Shore Hardness: 70 Shore D The elastomeric material is sprayed over equipment or encapsulating bags or foaming plastic encapsulants to create a durable outer coating that is resistant to puncture, tensile stress, and damage during transport to its final disposition.

A composition and process for encapsulating radioactive wastes to render them suitable for shipment according to the invention have been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

We claim:

1. A method of encapsulating a radioactive object to render the object suitable for shipment and/or storage, and including the steps of:

(a) preparing a plastic material;

(b) causing the plastic material to react with a foaming agent;

(c) generating a foaming plastic; and (d) encapsulating the object in the foaming plastic wherein the step of encapsulating the object in the foaming plastic includes the steps selected from the group consisting of:

(i) placing a radioactive object in a container, encapsulating the container in the foaming plastic, and allowing the foaming plastic to solidify around the container to form an impervious coating; and (ii) encapsulating the radioactive object in the foaming plastic, allowing the foaming plastic to solidify around the radioactive object to form an impervious coating;

wherein the foaming plastic comprises a rigid polyurethane foam with the composition comprising:
Polyol blend
Crosslinkers
Water
Fire retardant
Viscosity suppressant
Surfactants
Catalysts
Blowing agent
Polymeric Isocyanate
and the characteristics:
Free Rise Core Density: 2.4 lbs/ft$^3$
Molded Core Density: 2.8 lbs/ft$^3$
Compressive Strength: 37 lbs/in$^2$.

2. A method according to claim 1, wherein the foaming plastic comprises a rigid polyurethane foam with the composition comprising:

| INGREDIENT | % |
|---|---|
| Polyol blend | 34.78 |
| Crosslinkers | 1.45 |
| Water | 0.48 |
| Fire retardant | 3.60 |
| Viscosity suppressant | 1.09 |
| Surfactants | 0.72 |
| Catalysts | 0.14 |
| Blowing agent | 6.04 |
| Polymeric Isocyanate | 51.70 |
| TOTAL | 100.00 |

and the characteristics:
Free Rise Core Density: 2.4 lbs/ft$^3$
Molded Core Density: 2.8 lbs/ft$^3$
Compressive Strength: 37 lbs/in$^2$.

3. A method of encapsulating a radioactive object to render the object suitable for shipment and/or storage, and including the steps of:
(a) preparing a plastic material;
(b) causing the plastic material to react with a foaming agent;
(c) generating a foaming plastic; and
(d) encapsulating the object in the foaming plastic, wherein the step of encapsulating the object in the foaming plastic includes the steps selected from the group consisting of:
(i) placing a radioactive object in a container, encapsulating the container in the foaming plastic, and allowing the foaming plastic to solidify around the container to form an impervious coating; and
(ii) encapsulating the radioactive object in the foaming plastic, allowing the foaming plastic to solidify around the radioactive object to form an impervious coating;

wherein the foaming plastic comprises a rigid polyurethane foam with the composition comprising:
Polyol blend
Crosslinkers
Water
Fire retardant
Viscosity suppressant
Surfactants
Catalysts
Blowing agent
Polymeric Isocyanate
and the characteristics:
Free Rise Core Density: 6.3 lbs/ft$^3$
Compressive Strength: 135 lbs/in$^2$.

4. A method according to claim 3, wherein the foaming plastic comprises a rigid polyurethane foam with the composition comprising:

| INGREDIENT | % |
|---|---|
| Polyol blend | 34.45 |
| Crosslinkers | 3.83 |
| Water | 0.05 |
| Fire retardant | 3.83 |
| Viscosity suppressant | 1.41 |
| Surfactants | 0.72 |
| Catalysts | 0.12 |
| Blowing agent | 3.44 |
| Polymeric Isocyanate | 52.15 |
| TOTAL | 100.00 |

and the characteristics:
Free Rise Core Density: 6.3 lbs/ft$^3$
Compressive Strength: 135 lbs/in$^2$.

5. A method of encapsulating a radioactive object to render the object suitable for shipment and/or storage, and including the steps of:
(a) preparing a plastic material;
(b) causing the plastic material to react with a foaming agent;
(c) generating a foaming plastic; and
(d) encapsulating the object in the foaming plastic, wherein the step of encapsulating the object in the foaming plastic includes the steps selected from the group consisting of:
(i) placing a radioactive object in a container, encapsulating the container in the foaming plastic, and allowing the foaming plastic to solidify around the container to form an impervious coating; and
(ii) encapsulating the radioactive object in the foaming plastic, allowing the foaming plastic to solidify around the radioactive object to form an impervious coating;

wherein the foaming plastic comprises a rigid polyurethane foam with the composition comprising:
Polyol blend
Crosslinkers
Water
Viscosity suppressant
Surfactants
Catalysts
Blowing agent
Polymeric Isocyanate
and the characteristics:
Free Rise Core Density: 6.0 lbs/ft$^3$
Compressive Strength: 160 lbs/int.

6. A method according to claim 5, wherein the foaming plastic comprises a rigid polyurethane foam with the composition comprising:

| INGREDIENT | % |
|---|---|
| Polyol blend | 39.38 |
| Crosslinkers | 1.65 |

-continued

| INGREDIENT | % |
|---|---|
| Water | 0.12 |
| Viscosity suppressant | 3.07 |
| Surfactants | 0.47 |
| Catalysts | 0.12 |
| Blowing agent | 2.36 |
| Polymeric Isocyanate | 52.83 |
| TOTAL | 100.00 |

and the characteristics:
Free Rise Core Density: 6.0 lbs/ft$^3$
Compressive Strength: 160 lbs/in$^2$.

7. A method of encapsulating a radioactive object to render the object suitable for shipment and/or storage, and including the steps of:
(a) preparing a plastic material;
(b) causing the plastic material to react with a foaming agent;
(c) generating a foaming plastic; and
(d) encapsulating the object in the foaming plastic, wherein the step of encapsulating the object in the foaming plastic includes the steps selected from the group consisting of:
(i) placing a radioactive object in a container, encapsulating the container in the foaming plastic, and allowing the foaming plastic to solidify around the container to form an impervious coating; and
(ii) encapsulating the radioactive object in the foaming plastic, allowing the foaming plastic to solidify around the radioactive object to form an impervious coating;
wherein the foaming plastic comprises a rigid polyurethane foam with the composition comprising:
Polyol blend
Crosslinkers
Water
Fire retardant
Viscosity suppressant
Surfactants
Catalysts
Blowing agent
Polymeric Isocyanate
and the characteristics:
Free Rise Core Density: 6.5 lbs/ft$^3$
Compressive Strength: 150 lbs/in$^2$.

8. A method according to claim 7, wherein the foaming plastic comprises a rigid polyurethane foam with the composition comprising:

| INGREDIENT | % |
|---|---|
| Polyol blend | 33.50 |
| Crosslinkers | 4.78 |
| Water | 0.10 |
| Fire retardant | 4.31 |
| Viscosity suppressant | 0.57 |
| Surfactants | 0.38 |

-continued

| INGREDIENT | % |
|---|---|
| Catalysts | 1.82 |
| Blowing agent | 2.39 |
| Polymeric Isocyanate | 52.15 |
| TOTAL | 100.00 |

and the characteristics:
Free Rise Core Density: 6.5 lbs/ft$^3$
Compressive Strength: 150 lbs/in$^2$.

9. A method of encapsulating a radioactive object to render the object suitable for shipment and/or storage, and including the steps of:
(a) preparing a plastic material;
(b) causing the plastic material to react with a foaming agent;
(c) generating a foaming plastic; and
(d) encapsulating the object in the foaming plastic, wherein the step of encapsulating the object in the foaming plastic includes the steps selected from the group consisting of:
(i) placing a radioactive object in a container, encapsulating the container in the foaming plastic, and allowing the foaming plastic to solidify around the container to form an impervious coating; and
(ii) encapsulating the radioactive object in the foaming plastic, allowing the foaming plastic to solidify around the radioactive object to form an impervious coating;
wherein the encapsulated object is coated with a polyurea elastomeric coating with the following composition:
Polyetheramine blend
Amine Crosslinker
Moisture Scavenger
Isocyanate Prepolymer
and the characteristics:
Tensile Strength: 3000 lbs/in$^2$
Tear Strength: 436 lbs/in
Elongation: 364%
Shore Hardness: 70 Shore D.

10. A method according to claim 9, wherein the encapsulated object is coated with a polyuria elastomeric coating with the following composition:

| INGREDIENT | % |
|---|---|
| Polyetheramine blend | 42.31 |
| Amine Crosslinker | 4.81 |
| Moisture Scavenger | 0.96 |
| Isocyanate Prepolymer | 51.92 |
| TOTAL | 100.00 |

and the characteristics:
Tensile Strength: 3000 lbs/in$^2$
Tear Strength: 436 lbs/in
Elongation: 364%
Shore Hardness: 70 Shore D.

* * * * *